United States Patent [19]

Dayton et al.

[11] Patent Number: 4,864,185

[45] Date of Patent: Sep. 5, 1989

[54] AUTOMOTIVE LAMP HAVING AN INSULATING BASE

[75] Inventors: David R. Dayton; Lloyd K. Bucher; Richard M. Buck, all of Richmond, Ky.

[73] Assignee: North American Philips Corporation, New York, N.Y.

[21] Appl. No.: 851,615

[22] Filed: Apr. 14, 1986

[51] Int. Cl.[4] ..... H01J 5/48; H01J 5/50

[52] U.S. Cl. ..... 313/318; 439/36; 439/519; 439/611

[58] Field of Search ..... 313/318, 315; 339/144 R, 144 T, 145 R, 145 T, 17 D, 90 F, 91 L; 439/519, 273, 271, 36, 611

[56] References Cited

U.S. PATENT DOCUMENTS

| | | | |
|---|---|---|---|
| 3,798,588 | 3/1974 | Howe et al. | 339/127 |
| 3,979,627 | 9/1976 | Leaduaro et al. | 313/318 |
| 4,028,577 | 7/1977 | Gates et al. | 313/318 |
| 4,547,838 | 10/1985 | Wakimizo | 313/318 X |
| 4,595,859 | 6/1986 | Steiner et al. | 313/318 X |
| 4,603,278 | 7/1986 | Devir et al. | 313/318 |

*Primary Examiner*—David K. Moore
*Assistant Examiner*—Mark R. Powell
*Attorney, Agent, or Firm*—Brian J. Wieghaus

[57] ABSTRACT

An incandescent automotive lamp for mounting in a lamp socket comprising a light-transmitting envelope, an insulating base, and a plurality of conductive wires. The light-transmitting envelope contains an energizable light source and has a sealed-end portion. The insulating base includes a housing, a flange portion, a plurality of channels, and a divider portion. The housing has a cavity in which the sealed-end portion is secured. The flange portion is located on the housing and has a substantially bevelled frustum and a rim with diametrically opposed notches. Each channel passes through the housing and leads into the cavity. The divider portion depends from the bottom of the housing. The divider portion has a pair of substantially flat faces, a pair of sides, and a bottom. At least one of the faces is adjacent to the channels of the housing. Each side has a base notch. The conductive wires connect to the energizable light source and pass through the sealed-end portion of the envelope. Each wire passes through a separate channel of the base member. Each wire has a terminal portion. Each terminal portion extends downwardly from its associated channel and substantially alongside one flat face of the divider portion. Each terminal portion wraps around the bottom portion of the divider portion and extends upwardly substantially alongside the other flat face of the divider portion.

6 Claims, 5 Drawing Sheets

AUTOMOTIVE LAMP HAVING AN INSULATING BASE

BACKGROUND OF THE INVENTION

This invention relates to electric incandescent lamps, more particularly incandescent automotive lamps.

The well-known S-8 automotive lamp includes a glass envelope cemented in a brass, double contact, bayonet base and has been the industry standard for 70 years. The S-8 lamps are used in automotive lighting assemblies, particularly rear and front directional lights, reverse lights, fog lights, and brake lights. More recently the S-8 lamp is also available with an insulation base of plastic or ceramic. The base includes a depending portion lead-support located at its bottom with wire terminals of the lamp extending alongside and wrapping around the depending portion lead-support.

S-8 lamps suffer from a known disadvantage of corrosion of the metallic components of the lamp and its socket. For instance, because of a conventional loose seal between the base of the lamp and its socket, dust, dirt, and moisture from condensation and dampness infiltrate the lamp socket. Consequently, in brass-based lamps the base itself will corrode; in insulation-based lamps the wire terminals will corrode; and in both lamps the metallic components of the lamp socket will corrode.

SUMMARY OF THE INVENTION

It is an object of the present invention to provide an improved automotive lamp, more particularly an automotive lamp having an improved base.

One of the features of this invention is that the base of the lamp has a pair of opposed base notches, and a flange having a substantially bevelled frustum and a rim with a pair of diametrically opposed rim notches.

One advantage of this invention is that the lamp firmly fits and tightly seals within its socket minimizing the infiltration of dirt, dust and moisture within its socket.

In accordance with this invention, there is provided an incandescent automotive lamp for mounting in a lamp socket. The lamp includes a light-transmitting envelope, an insulating base, and a plurality of conductive wires. The light-transmitting envelope contains an energizable light source and has a sealed-end portion. The base includes a housing, a flange portion, a plurality of channels, and a lead-support portion. The housing has a cavity in which the sealed-end portion of the lamp envelope is secured. The flange portion of the housing has a substantially bevelled frustum and a rim with diametrically opposed notches. Each channel passes through the housing and leads into the cavity in the housing. The lead-support portion depends from the bottom of the housing. The lead-support portion has a pair of substantially flat faces, a pair of sides, and a bottom. At least one face is adjacent to the channels of the housing. Each side has a base notch. The conductive wires of the lamp connect to the energizable light source and pass through the sealed-end portion of the envelope. Each wire also passes through a separate channel of the base. Each wire has a terminal portion. Each terminal portion extends downwardly from its associated channel and substantially alongside one flat face of the divider portion. Each terminal portion wraps around the bottom portion of the divider portion, and extends upwardly substantially alongside the other flat face.

Other objects, features and advantages will become apparent to those skilled in the art from the following description and appended claims when considered in conjunction with the accompanying drawing.

BRIEF DESCRIPTION OF THE DRAWINGS

The invention is more fully described hereafter in conjunction with the accompanying drawing, in which.

DESCRIPTION OF THE PREFERRED

Figure 2:
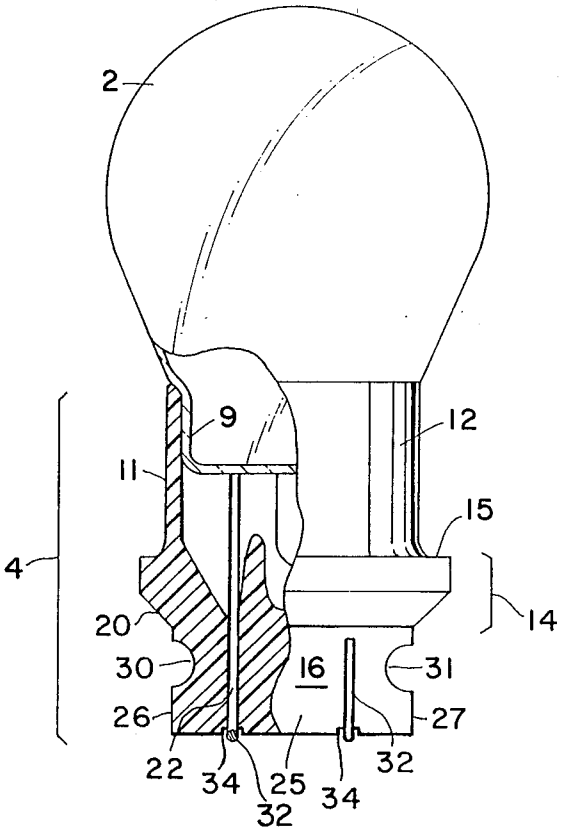
FIG. 2 is a partial cross-sectional view of the back of the lamp of FIG. 1.

In the various figures of the drawing corresponding parts are identified with the same reference characters. The drawing is schematic only and not to scale.

Figure 1:
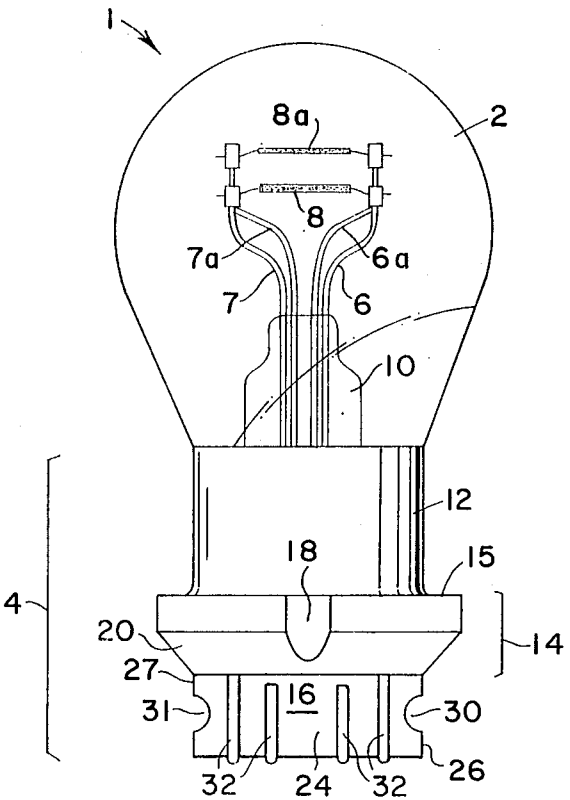
FIG. 1 is a front view of a lamp constructed in accordance with the invention.

Referring to FIG. 1 of the drawing, there is shown an incandescent automotive lamp 1 having hermetically sealed, light-transmitting envelope 2, insulating base 4, and conductive wires 6, 6*a* and 7, 7*a*. Envelope 2 contains an energizable light source including coiled filaments 8 and 8*a* connected respectively to wires 6, 7 and 6*a*, 7*a*. Conductive wires 6, 6*a* and 7, 7*a* are molded in and supported by insulated press 10, formed in sealed-end portion 9 (FIG. 2) of envelope 2.

Figure 3:
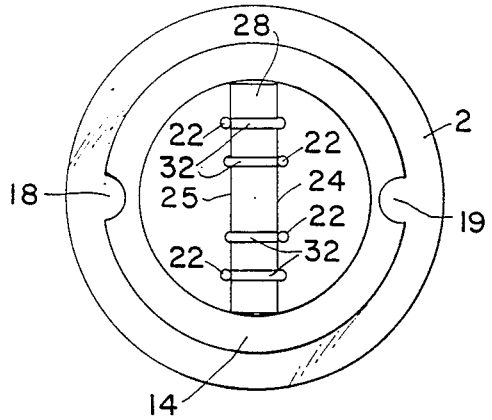
FIG. 3 is a partial bottom view of the lamp of FIG. 1.

As shown in FIG. 2 of the drawing, base 4 comprises housing 12 with a cavity 11, flange portion 14, and lead-support portion 16. Base 4 is preferably formed in one piece of plastic or ceramic. Cavity 11 accommodates sealed-end portion 9, preferably fastened within cavity 11 by epoxy cement for better water resistance and a stronger seal. Cavity 11 maybe of any geometric shape, but a cylindrical cavity is preferred. Flange portion 14 is located at the bottom of housing 12 and has substantially bevelled frustum 20 and rim 15. Rim 15 has a pair of diametrically opposed notches 18 and 19 (FIGS. 1 and 3).

A plurality of channels 22 (FIG. 3) passes through housing 12. One end of each channel 22 leads into cavity 11. Lead-support portion 16 depends from the bottom of housing 12. Lead-support portion 16 has opposed substantially flat faces 24 (FIG. 1) and 25 (FIG. 2), opposed sides 26 and 27, and bottom 28 (FIG. 3). Each face 24 and 25 (FIGS. 3 and 4) is adjacent to channels 22 on the bottom side of housing 12, see FIG. 3. Side 26 has base notch 30 (FIGS. 1 and 2), and side 27 has base notch 31.

Figure 4:
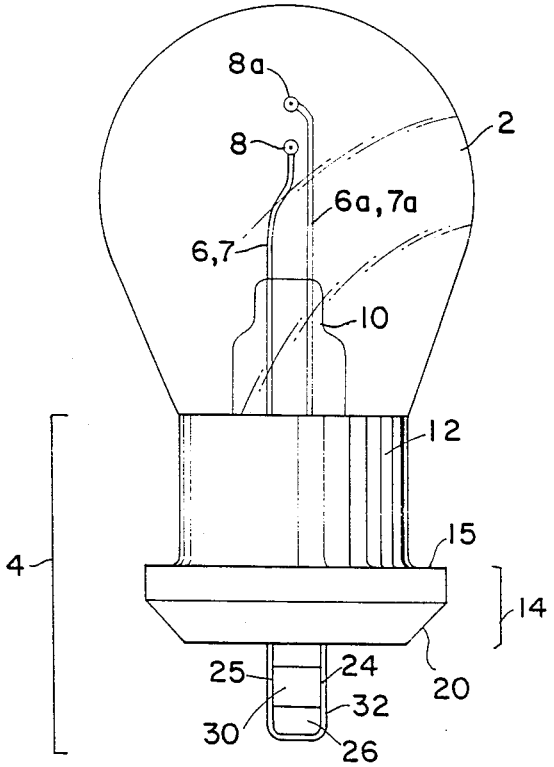
FIG. 4 is a side view of the lamp of FIG. 1.

Conductive wires 6, 6*a* and 7, 7*a* pass through sealed-end portion 9 and into cavity 11. Each wire then passes through a separate one of channels 22 of base 4 (not shown). Each wire has a terminal portion 32. Each terminal portion extends downwardly from its associated channel 22 and substantially alongside face 24 of divider portion 16 (FIG. 4). Each terminal portion wraps substantially around bottom 28 (FIG. 3) of divider portion 16 and extends upwardly substantially alongside the other face 25 of divider portion 16.

In the preferred embodiment of the lamp, bottom 28 of lead-support portion 16 has a plurality of slots 34. The width of each slot 34 is made slightly smaller in size than the diameter of each terminal portion 32 of conductive wires 6, 6*a* and 7, 7*a*. As a result each terminal portion 32 is force fit within a separate slot 34, requiring no soldering for a secure fit.

Figure 6:
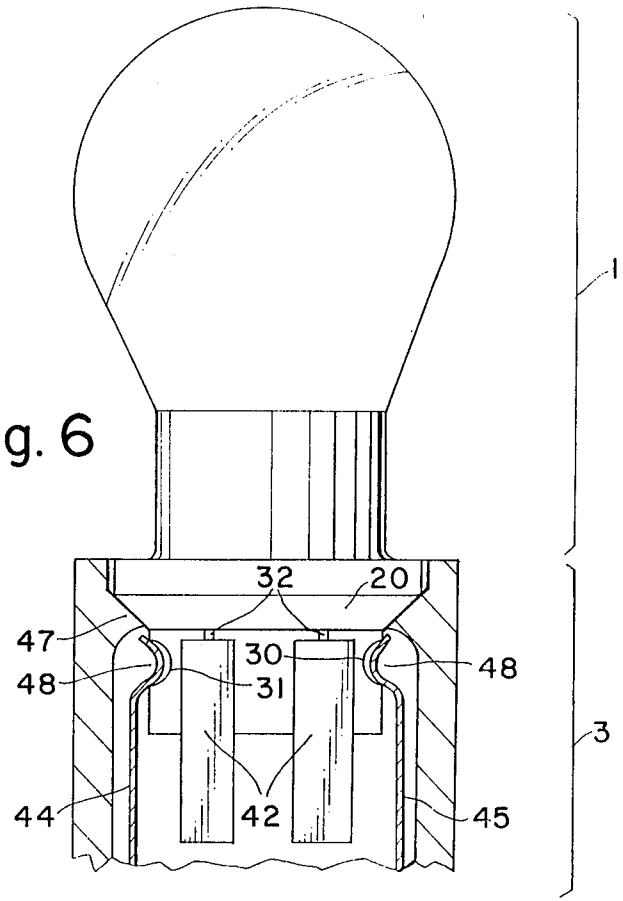
FIG. 6 is a front view of the lamp of FIG. 1 inserted in the lamp socket of FIG. 5.
Figure 5:
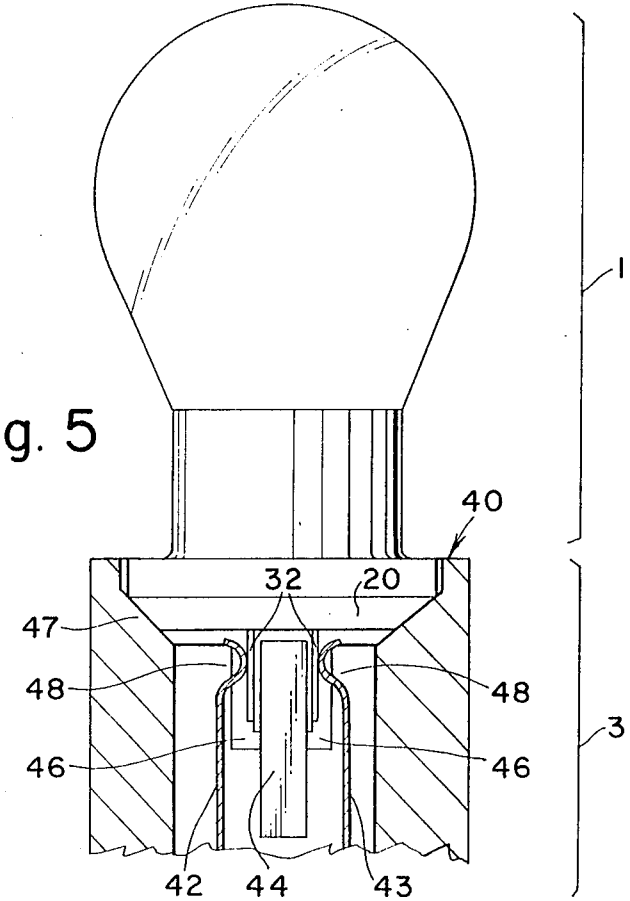
FIG. 5 is a side view of the lamp of FIG. 1 inserted in a lamp socket.

Referring to FIGS. 5 and 6 of the drawing, there is shown lamp 1 in combination with lamp socket 3. Lamp socket 3 comprises socket housing 40, two pair of socket contacts 42 and 43, locating and lugs 44 and 45. Socket housing 40 has cavity 46 in which lead-support portion 16 of lamp 1 is inserted. Socket contacts 42 and 43 are secured within socket housing 40 in any acceptable manner such as by being molded within housing 40, as are locating lugs 44 and 45. As can be seen, locating lugs 44 and 45, and socket contacts 42 and 43, have a similarly shaped ear-like protuberance 48. Cavity 46 of housing 40 is shaped as a substantially bevelled frustum 47 at its top.

Figure 7:
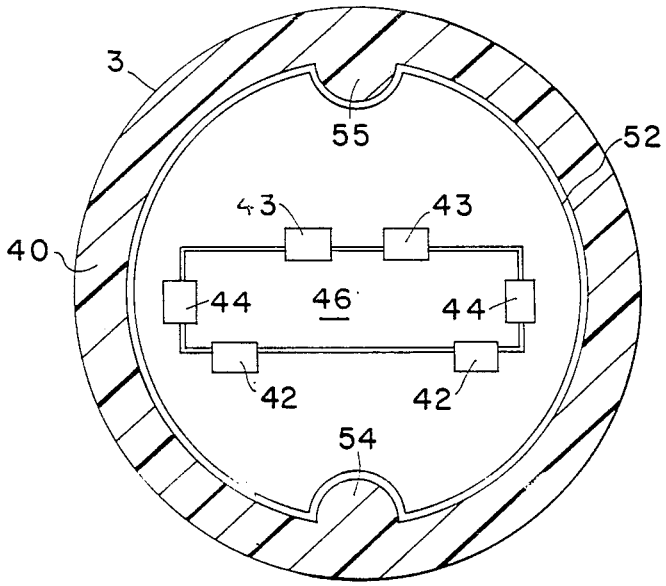
FIG. 7 is a top view of the lamp socket of FIGS. 5 and 6.

As shown in FIG. 7, socket housing 40 has rim 52 with diametrically opposed nubs 54 and 55 protruding into cavity portion 46. When lamp 1 is inserted in socket 3, each nub 54 and 55 of socket housing 40 firmly fits within a different one of rim notches 18 and 19 of flange portion 14 of lamp 1. Each socket contact 42 and 43 conductively contacts with terminal portion 32 of a different one of wires 6, 6*a* and 7, 7*a*. Each locating lug 44 and 45 locks within a different one of base notches 30 and 31 and bevelled frustum 20 fits and aligns within cavity 46 in a complementary fashion.

Figure 8:
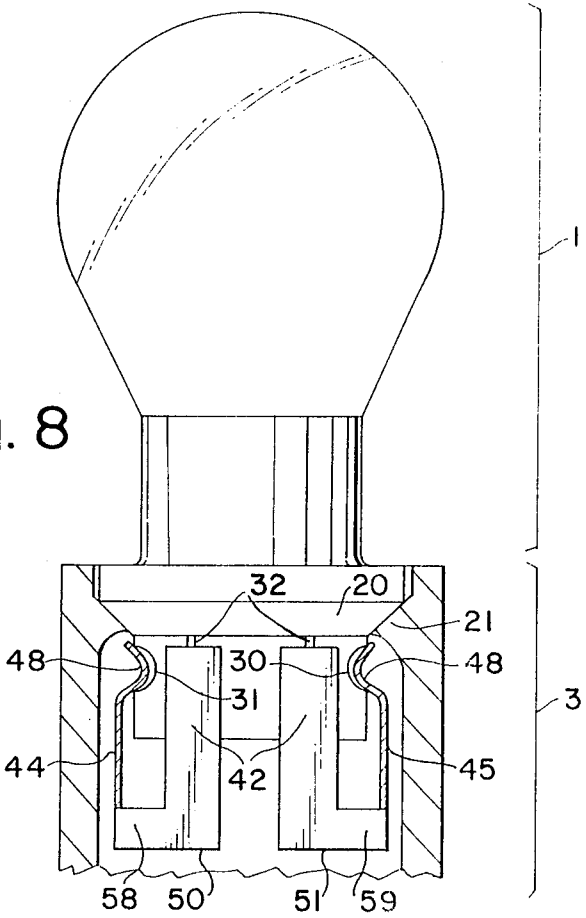
FIG. 8 is a front view of the lamp of FIG. 1 inserted in an alternative embodiment of the lamp socket in FIG. 5.
Figure 9:
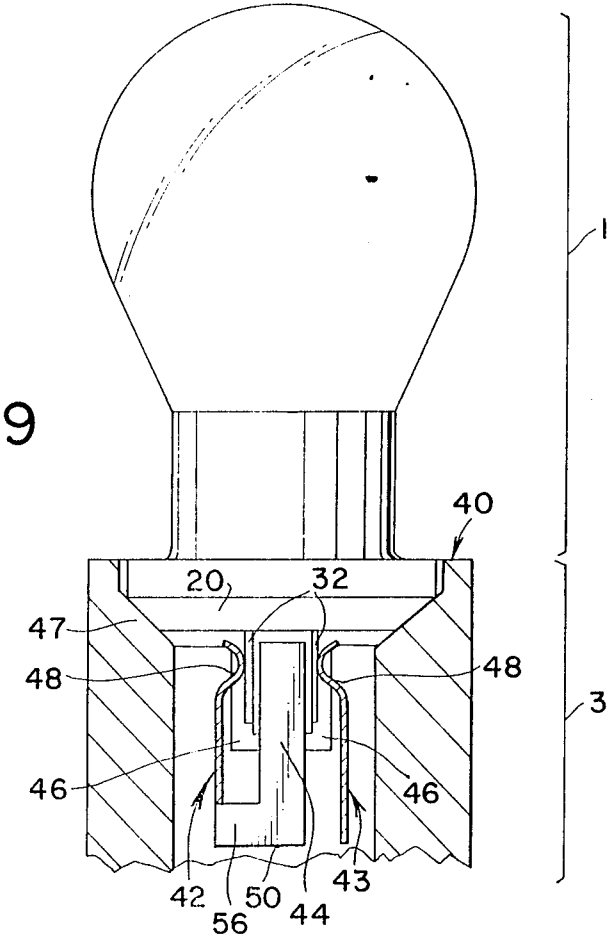
FIG. 9 is a side view of the lamp and the lamp socket in FIG. 8.

In an alternative embodiment shown in FIGS. 8 and 9, lamp socket 40 includes a pair of support elements 50 and 51. Each support element 50 and 51 is secured within socket housing 40 in any acceptable manner such as being molded into housing 40. Support element 50 has first portion 56 and second portion 58, and support element 51 has first portion 57 (not shown) and second portion 59. Each first and second portion is substantially flat and perpendicularly attached to one another. Locating lugs 44 and 45 perpendicularly extends from an end of an associated first portion 56 and 57 (not shown). Socket contacts 42 and 43 perpendicularly extends from an end of an associated second portion 58 and 59. Support element 50 together with its locating lug 44 and socket contact 42, and support element 51 together with its locating lug 45 and socket contact 43, each form a unitary structure. In this embodiment locating lugs 44 and 45, and socket contacts 42 and 43, also have a similarly shaped ear-like protuberances 48.

Those skilled in the art of incandescent automotive lamps will appreciate that each embodiment of the lamp will functionally situate within its lamp socket at reversible attitudes of 0° and 180° . That is, it can be reversed in its socket and still works. The reversibility of the automotive lamp will allow robotics handling of the lamp during the manufacture of automobiles.

Although the invention has been described with respect to a specific embodiment, it will be appreciated that modifications and changes may be made by those skilled in the art without departing from the true spirit and scope of the invention. For that reason the description is to be considered illustrative only and not restrictive.

What we claim is:

1. An electric lamp comprising:

an envelope containing an energizable light source and having a sealed end portion, said envelope defining a lamp axis;

a plurality of conductive leads connected to the energizable light source extending through said sealed end portion in a direction generally parallel to said lamp axis; and an insulating base member having a housing portion and a lead-support portion, said housing portion having a bottom surface, and a cavity in which said sealed end portion is secured, said lead-support portion extending away from said bottom surface aligned with said lamp axis, and having a pair of parallel flat faces and an end face extending between said flat faces remote from said envelope, each of said conductive leads passing through said bottom surface of said housing portion adjacent one of said flat faces, extending along that face to said end face, across said end face, and along the other of said flat faces, the portions of the conductive leads extending along the faces being exposed surfaces adapted to be engaged by electrical contacts when the lamp is inserted in a receptacle.

2. A lamp as claimed in claim 1, wherein said light source is connected to two conductive, leads, said two conductive leads passing through said bottom surface of said housing portion adjacent a same one of said flat faces.

3. A lamp as claimed in claim 1, wherein said light source comprises first and second filaments respectively connected to first and second pairs of said conductive leads, said first pair of conductive leads passing through said bottom surface of said housing portion adjacent a same one of said faces and extending symmetrically along said face, across said end face, and along at least part of the other flat face, and said second pair of conductive leads passing through said bottom surface of said housing portion adjacent said other flat face, spaced apart and symmetrically arranged, passing across said end face and along at least part of said one face, said first pair of conductive leads being disposed between said second pair of conductive leads along said flat faces and said end face, whereby said lamp is adapted for operable engagement with a receptacle having contacts arranged to engage said conductive leads along either or both faces of the lamp.

4. An electric lamp in combustion with a lamp socket, comprising:

a lamp envelope sealed in a gas-tight manner containing an energizable light source and a having a sealed end portion, said lamp envelope defining a lamp axis;

an insulative base comprising a housing having a cavity in which said sealed end portion is secured and a bottom surface, a flange having a first bevelled frustum extending around the periphery of said housing adjacent said bottom surface, said frustum tapering inwardly in a direction from said envelope toward said bottom surface, and a lead-support portion extending away from said bottom surface aligned with said lamp axis having a pair of parallel flat faces and an end face extending between said parallel flat faces remote from said bottom surface;

a plurality of conductive leads connected to said light source extending through said sealed end portion and said housing, passing through said bottom surface and emerging adjacent one of said flat faces of said lead-support, each conductive lead extending along a respective adjacent flat face, across said end face, and along the other flat face, and a lamp socket comprising an opening surface defining a second bevelled frustum complementary to said first bevelled frustum of said insulative base, a cavity for receiving said lead-support portion, and a plurality of contacts within said cavity spaced for conductively contacting a respective one of said conductive leads when said insulative base is inserted in said socket;

means for aligning said insulative base in said socket in either of two reversible positions with each socket contact contacting a respective conductive lead; and means for detachably securing said insulative base in said socket with said base member aligned in either of said reversible positions and with said first and second complementary frustums biased against each other in sealing engagement.

5. The combination of lamp and socket as claimed in claim 4, wherein said means for aligning said insulative base in said socket comprises the insulative base flange having a pair of diametrically opposed flange notches extending parallel to said lamp axis and said socket opening surface having a protuberance shaped to mate with one of said flange notches when said lamp base is secured in said socket; and said means for detachably securing said base in said socket comprises said lead-support portion having a pair of diametrically opposed lead-support notches extending perpendicular to said lamp axis and said parallel flat faces, and said socket comprises a resilient tongue having a portion shaped to mate with said lead-support notches, said portion of said resilient tongue being biased in said lead-support notch when said lamp base is secured in said socket.

6. The combination of lamp and socket as claimed in claim 5, wherein said light source comprises first and second filaments respectively connected to first and second pairs of conductive leads, said first pair of conductive leads passing through said bottom surface of said housing adjacent a same one of said flat faces and extending symmetrically along said face, across said end face, and along at least part of the other flat face, and said second pair of conductive leads passing through said bottom surface of said housing adjacent said other flat face, spaced apart and symmetrically arranged, passing across said end face and along at least part of said one face, said first pair of conductive leads being disposed between said second pair of conductive leads along said faces and said end.

* * * * *